US005776310A

United States Patent [19]

McDermott et al.

[11] Patent Number: 5,776,310

[45] Date of Patent: Jul. 7, 1998

[54] METHOD FOR TREATMENT OF PAPER MACHINE PRESS SECTION FELTS

[75] Inventors: Michael Anthony McDermott, Liverpool, Great Britain; Jurgen Friedrich Schuetz, Antwerp, Belgium

[73] Assignee: BetzDearborn Inc., Trevose, Pa.

[21] Appl. No.: 842,142

[22] Filed: Apr. 23, 1997

Related U.S. Application Data

[62] Division of Ser. No. 461,486, Jun. 5, 1995, Pat. No. 5,651,812.

[30] Foreign Application Priority Data

Nov. 22, 1994 [DE] Germany ..... 44 43 181.3

[51] Int. Cl.[6] ..... D21F 1/32

[52] U.S. Cl. ..... 162/199; 162/DIG. 4

[58] Field of Search ..... 162/199, 72, DIG. 4

[56] References Cited

U.S. PATENT DOCUMENTS

| | | | |
|---|---|---|---|
| 3,910,815 | 10/1975 | Shelor | 162/199 |
| 4,554,307 | 11/1985 | Farrar et al. | 106/447 |
| 4,634,532 | 1/1987 | Logan et al. | 252/181 |
| 4,715,931 | 12/1987 | Schellhamer et al. | 162/199 |
| 4,861,429 | 8/1989 | Barnett et al. | 162/199 |
| 4,895,622 | 1/1990 | Barnett et al. | 162/199 |
| 5,167,767 | 12/1992 | Owiti et al. | 162/199 |
| 5,496,477 | 3/1996 | Tang et al. | 252/8.6 |

FOREIGN PATENT DOCUMENTS

| | | | |
|---|---|---|---|
| 1319078 | 6/1993 | Canada | C11D 7/50 |

*Primary Examiner*—Donald E. Czaja
*Assistant Examiner*—Jose A. Fortuna
*Attorney, Agent, or Firm*—Alexander D. Ricci; Philip H. Von Neida

[57] ABSTRACT

This invention relates to the treatment of press section felts. The treatment comprises applying to the felts an effective amount of a felt cleaning agent comprising one or more anionic polymers, selected from the group of polycarboxylic acids and derivatives thereof having an average molecular weight of 500 to less than 5000, 2-phosphino-1,2,4-tricarboxybutane, and an amphoteric surfactant selected from the group consisting of alkyl-N-(3 aminopropyl)-glycines and alkyl-di(aminoethyl)-glycines. The cleaning agent inhibits the blinding of paper machine press section felts and provides improved felt conditioning at much lower concentration levels than known commercial products.

6 Claims, 4 Drawing Sheets

METHOD FOR TREATMENT OF PAPER MACHINE PRESS SECTION FELTS

This is a continuation divisional of application Ser. No. 08/461,486 filed Jun. 5, 1995, now U.S. Pat. No. 5,651,812.

The invention relates to agents for the treatment of paper machine press section felts and their use in the paper making process.

The blinding of drying section felts by the deposition of inorganic materials used in the paper making process is a problem that is likely to become much more widespread in the future because of the increasing use of inorganic fillers, and because of the increasingly closed water systems used in paper mills.

Fillers have always been used in the paper making process and are currently used in a wide range of paper and board products. The amount of filler used varies from some grades of newsprint containing 3% by weight filler to 30% by weight used in some magazine and some printing papers.

The reasons for adding fillers are to improve some paper properties and to reduce raw material costs. Fillers can be divided into broad groups, namely general purpose fillers used at loading levels greater than 10% by weight and speciality fillers used at low levels. While the former are a compromise between economic aspects and improvement of paper properties, the latter are generally used to improve a specific aspect of paper (e.g. brightness). Examples of general purpose fillers are kaolin (china clay), chalk and limestone (calcium carbonate), and talc. Speciality fillers include titanium dioxide, calcined clay, synthetic aluminosilicates and precipitated silica.

The amount of filler retained by the paper is very important, the closer to 100% retention the better. On some machines, however, first pass retention is as low as 30%. Most of the nonretained filler goes into the white water, however, some loose filler is carried by the paper into the drying section. The loose filler is picked up by the press felts along with moisture. Most of this filler is removed along with water, however, some is retained. The build up of inorganic fillers on felts reduces their air-permeability and moisture removing ability, necessitating regular breaks to shock clean the felts. Filler particles are an abrasive (especially calcium carbonate) and this can radically reduce felt life.

The mechanism of filler build-up can be by aggregation, coalescence, particle growth or a combination thereof. Aggreation involves two types of flocculation, bridging and depletion, and normally involves other materials such as polymers and retention aids. Coalescence occurs when two particles collide and is often called sintering. The process occurs when surface groups rearrange themselves to provide a surface match (usually at a grain boundary). The result is a larger particle with a lower surface energy than the two separate particles, hence this process is entropy driven. Temperature will obviously be a factor in such a process.

Particle growth occurs when the solid particle is slightly soluble in the dispersion medium. Because of the phenomena of surface tension, small particles are more soluble than large particles. Consequently, molecules on the smaller particles will tend to dissolve into the media, and redeposit on larger particles.

In general, calcium carbonate will be particularly prone to particle growth, whereas other fillers will be more prone to coalescence. Aggregation will depend on conditions on the rest of the machine.

There are three main methods to prevent the deposition of fillers on felts, namely destruction of filler before deposition, crystal modification and dispersion. Destruction of filler before deposition is possible with calcium carbonate by spraying with mild acid solution since it breaks down under even mild acid conditions under development of carbon dioxide. Other fillers cannot be destroyed by such simple means. Titanium dioxide, alum and clay only dissolve in fused caustic or concentrated sulphuric acid (which would also dissolve the felt).

Many polymeric control agents work by crystal modification. The polymer is adsorbed on vacant sites on the crystal, disrupting the crystal lattice, and preventing crystal growth. This results in smaller, softer and more easily dispersed crystals.

In the dispersion method the substrate is adsorbed onto the particle increasing the potential energy barrier to aggregation and thus stabilizing the dispersion. The size of the polymer also prevents the close approach of other particles. This is called steric stabilization.

Methods to inhibit contamination deposition in paper making felts are known in the prior art. Thus U.S. Pat. No. 4,715,931 discloses the use of a hydroxylated carboxylic acid for inhibiting aluminum hydroxide deposition in paper making felts. Preferably the carboxylic acid is used in combination with surfactants. From U.S. Pat. No. 4,895,622 an improved press felt conditioning treatment is known which comprises applying to the felt a relatively low molecular weight organic, anionic polymer and at least one hydrophilic, non-ionic or anionic surfactant. The polymer preferably has an acrylic acid or methacrylic acid functionality and a molecular weight of 5,000 to 200,000.

In view of the above it is an object of the present invention to provide an agent for treatment of paper machine press section felts with improved deposition inhibition properties. It is a further object of the invention to provide such an agent resulting in improved felt conditioning.

Figure 1:
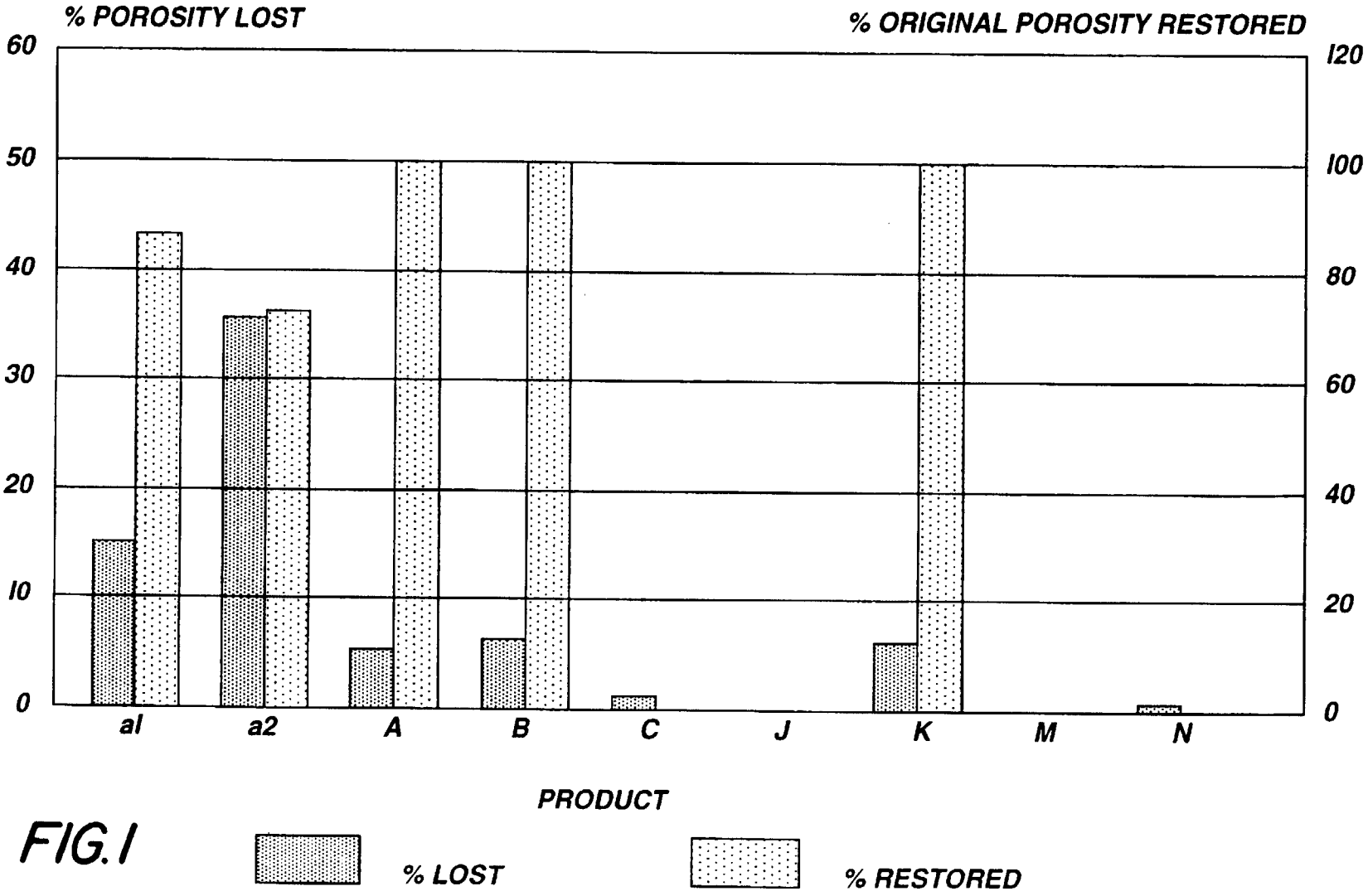
FIG. 1, FIG. 2 and FIG. 3 demonstrate the effect of various anionic polymers on deposition of calcium carbonate and restored porosity.

Thus the invention relates to an agent for treatment of paper machine press section felts comprising one or more anionic polymers having a weight average molecular weight of 500 to less than 5000 selected from polycarboxylic acids and derivatives thereof, and/or 2-phosphino-1,2,4-tricarboxybutane.

Preferred embodiments and advantages of the invention will become apparent from the following detailed description of the invention and the subclaims.

It was surprisingly found that 2-phosphino-1,2,4-tricarboxybutane and/or the anionic polymers used according to the invention, preferably in combination with a surfactant, effectively inhibit the blinding of paper machine press section felts and provide improved felt conditioning. Thus the felts can be used for a longer time without interruptions for cleaning, thereby improving the economy of the paper making process. Surprisingly these advantages are obtained by employing the agent according to the invention at much lower concentration levels as recommended for known commercial products.

Suitable polymeric polycarboxylic acids, which do not include hydroxylated polycarboxylic acids, and derivatives thereof include polymaleic acid, polymaleic acid copolymers (comonomers are e.g. acrylic acid and vinyl acetate), polyphosphinocarboxylic acid $-[PO-(CH_2)_x-CH(CO_2H)]_n$ (x=1 to 3; n dependent on molecular weight) and modifications thereof, and polyacrylic acid. Useful are also the salts, preferably the alkali salts of these polycarboxylic acids. The weight average molecular weight of these polymeric polycarboxylic acids is in the range of 500 to less than 5000, preferably in the range of about 1000 to about 4000.

Very good results have been obtained with a combination of sodium polyacrylate and 2-phosphino-1,2,4-tricarboxybutane.

The surfactant is preferably an amphoteric or non-ionic surfactant, most preferably an amphoteric surfactant. Particularly useful are alkyl-N-(3-aminopropyl)-glycines in which the alkyl group preferably comprises 14 to 16 carbon atoms. Similarly useful are alkyl-di(aminoethyl)-glycines in which the alkyl group comprises 10 to 14 carbon atoms. Besides these amphoteric surfactants very good results were also obtained with non-ionic surfactants like ethoxylated fatty alcohols, particularly $C_{10}$ fatty alcohols with 5 or 7 EO groups.

The agent according to the invention is applied to the felts in form of an aqueous spray. The spray solution usually comprises 50 to 90% by weight of water. The amount of the agent according to the invention used depends on the conditions of the paper making process and particulary the white water composition. Based on the white water, usually concentrations of 100 ppm or less of the anionic polymer and 100 ppm or less of the surfactant provide suitable results. Thus the total concentration of all active ingredients generally ranges from 20 to 200 ppm, very good results are already being obtained at 20 to 50 ppm.

Practice of the invention will become further apparent from the following non-limiting examples, which were carried out using a continuous test apparatus as described below with reference to FIG. 4.

Figure 4:
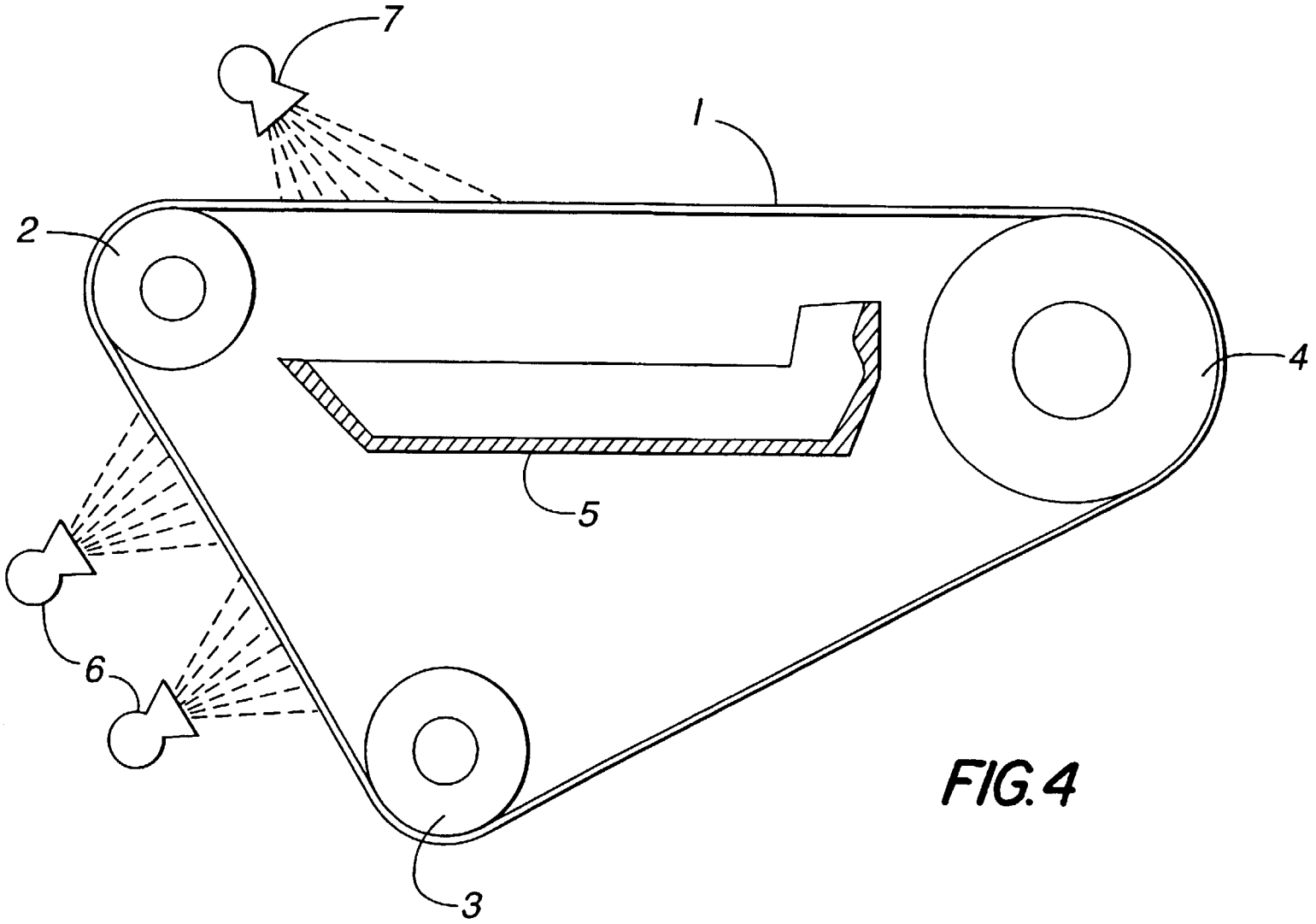
FIG. 4 is a schematic of a continuous test apparatus used in the examples.

FIG. 4 is a schematic drawing of the apparatus used in the Examples. A loop of felt 1 from a paper machine is rotated clockwise around three stainless steel rollers. Two are simple tension rollers 2, 3, the other is a combined drive and vacuum roller 4. The speed of the roller can be adjusted from 0 to 450 m per minute. The vacuum roll removes water from the felt (>90%) by applying a constant vacuum to the underside of the felt. Water thus removed, can be returned to a main tank, diverted into a measuring cylinder, or simply drained. A drip tray 5 is also fitted to collect any excess water falling from the felt. This can be routed in a similar manner to water removed by the vacuum roll. Further the apparatus comprises tanks for the white water and different spraying solutions which are transported and applied through suitable pumps and spray bars (not all shown). Spray heads 6 serve to apply the deposition forming material (e.g. calcium chloride and sodium carbonate solutions for the deposition of calcium carbonate), and spray head 7 serves to apply the agent of the present invention.

The air permeability of the felts is determined using a Frazier Differential Pressure Air Permeability Machine.

EXAMPLE 1

Tests were run using the continous test apparatus with a synthetic polyamide based felt. Calcium carbonate was produced in situ by spraying calcium chloride and sodium carbonate solutions onto the felt. In addition solutions of anionic polymers were sprayed onto the felt in an amount corresponding to 100 ppm based on the simulated white water. The standard test conditions were six hours duration, 50° C. and 30 psi spray pressure.

The percentage difference in the air-permeability before and after the run as well as the percentage of the air permeability the felt is restored to after standard cleaning with an acidic cleaning agent (Daraclean 7154 (5%)) were determined. If the reduction in permeability was less than 1%, then no cleaning was performed.

The following anionic polymers were tested:

1. a1=3 hr Blank
2. a2=6 hr Blank
3. A=Polymaleic acid (Mw 1000)
4. B=Polymaleic acid copolymer (Mw 800)*
5. C=Modified Polyphosphinocarboxcylic acid (Mw 3500)
6. J=Polyacrylic acid (Mw 2000)
7. K=2-Phosphino-1,2,4-tricarboxybutane (M 287)
8. M=Sodium polyacrylate (Mw 4000)
9. N=Polyacrylic acid (Mw 4000)

* The comonomers are acrylic acid, maleic acid and vinyl acetate

The test results are shown in FIG. 1 and clearly demonstrate the excellent performance of the anionic polymers useful in the present invention with regard to both inhibition of deposition of calcium carbonate and restored porosity.

EXAMPLE 2

Figure 2:
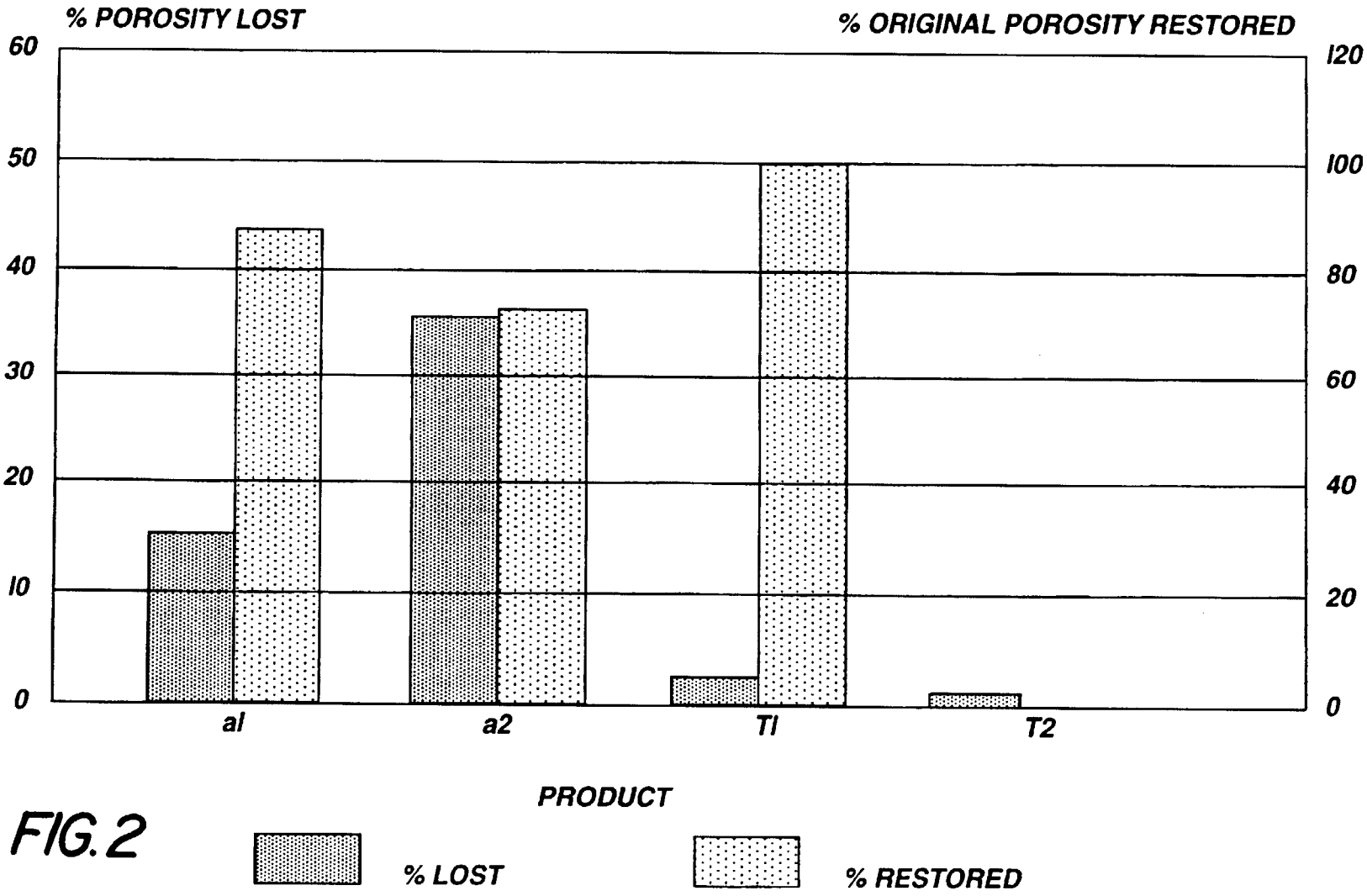

Example 1 was repeated with two test solutions. Test solution 1 ($T_1$) comprised 87% by weight deionised water, 3.0% by weight $C_{14}C_{16}$-alkyl-N-(3-amninopropyl)-glycine and 10% by weight sodium polyacrylate (Mw 4000). Test solution 2 ($T_2$) comprised 94.5% by weight deionised water, 3.0% by weight $C_{14-C16}$-alkyl-N-(3aminopropyl)-glycine, 2.0% by weight sodium polyacrylate (Mw 4000) and 0.5% by weight 2-phosphino-1,2,4-tricarboxybutane (M 287). Both products were tested at 100 ppm active ingredients. The results (including blank runs a1 and a2 as defined in Example 1) are shown in FIG. 2 and demonstrate the excellent performance of these products.

EXAMPLE 3

Figure 3:
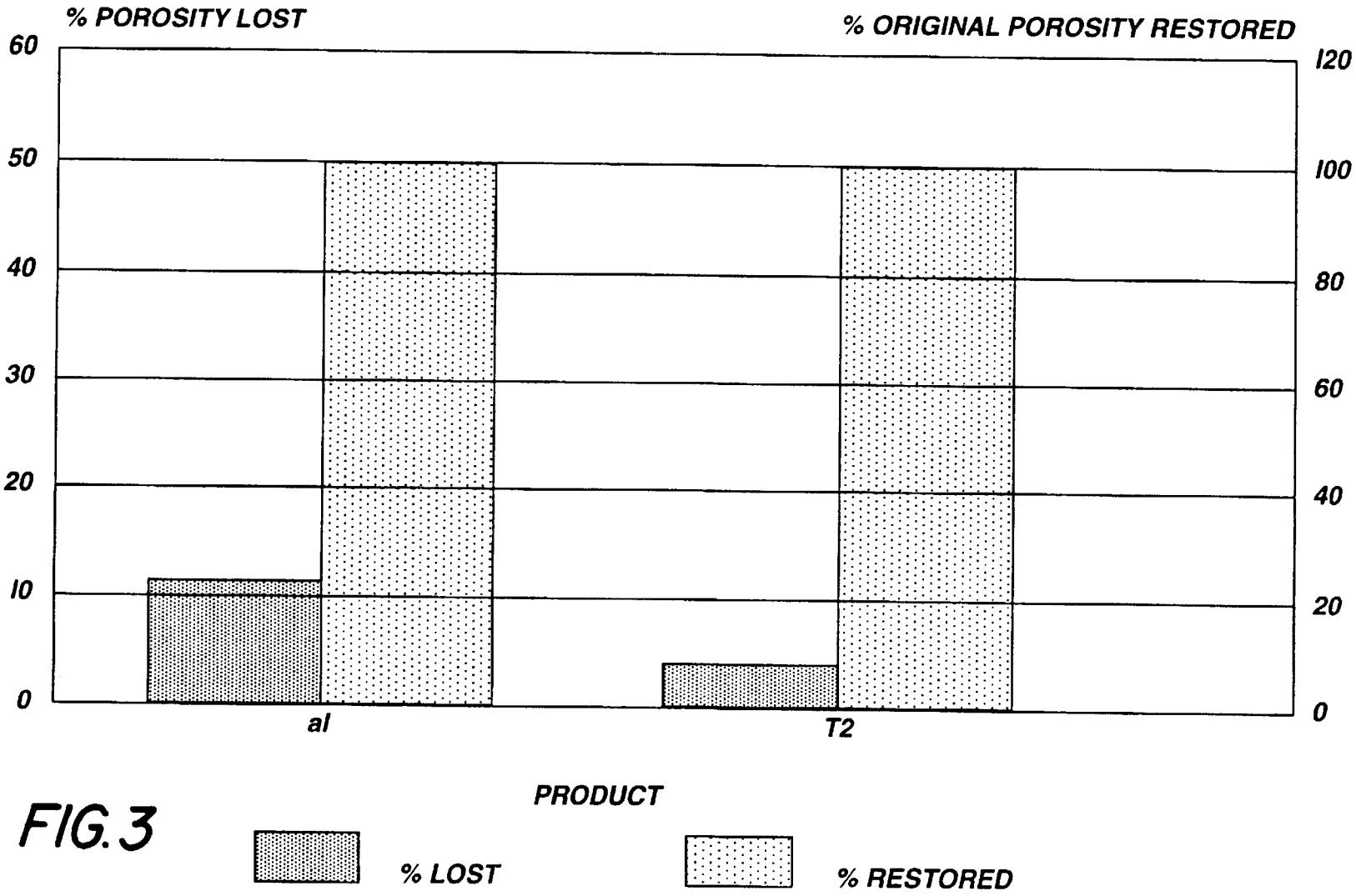

Example 1 was repeated. However, instead of calcium carbonate china clay was deposited on the felt. The results of a blank run (6 hr) and obtained with test solution 2 ($T_2$) are shown in FIG. 3.

We claim:

1. In a process for inhibiting the blinding of paper machine press section felts in which papermaking felt is cleaned with a felt cleaning agent and wherein a vacuum is applied to a bottom surface of said felt to remove water, and the removed water is then sent to a white water system, the improvement comprising; cleaning said felts with an effective amount of an aqueous solution of a cleaning agent, said cleaning agent comprising;

a) at least one anionic polymer selected from the group consisting of polycarboxylic acids and derivatives thereof, having an average molecular weight of 500 to less than 5000;

b) 2-phosphino-1,2,4-tricarboxybutane, and;

c) an amphoteric surfactant selected from the group consisting of alkyl-N-(3aminopropyl)-glycines and alkyl-di(aminoethyl)-glycines.

2. Method according to claim 1 wherein the concentration of the anionic polymer and 2-phosphino-1,2,4-tricarboxybutane is 100 ppm or less, based on the white water.

3. Method according to claim 1 wherein the concentration of the amphotheric surfactant is 100 ppm or less, based on the white water.

4. Method according to claim 1 wherein the total concentration of active ingredients is 20 to 200 ppm. based on the white water.

5. Method according to claim 1 wherein total concentration of active ingredients is 20 to 50 ppm. based on the white water.

6. Method according to claim 1 wherein the aqueous solution of said agent comprises 50 to 90% by weight of water and is sprayed onto the paper machine press section felts.

* * * * *